US010531730B2

(12) United States Patent
Diaz et al.

(10) Patent No.: US 10,531,730 B2
(45) Date of Patent: Jan. 14, 2020

(54) UTILITY CART PORTABLE PLANS TABLE

(71) Applicants: Jonathan Diaz, Santa Clara, CA (US); Mike Herrera, Santa Clara, CA (US)

(72) Inventors: Jonathan Diaz, Santa Clara, CA (US); Mike Herrera, Santa Clara, CA (US)

( * ) Notice: Subject to any disclaimer, the term of this patent is extended or adjusted under 35 U.S.C. 154(b) by 0 days.

(21) Appl. No.: 16/256,978

(22) Filed: Jan. 24, 2019

(65) Prior Publication Data

US 2019/0166988 A1 Jun. 6, 2019

Related U.S. Application Data

(63) Continuation of application No. 15/829,825, filed on Dec. 1, 2017.

(51) Int. Cl.

| | |
|---|---|
| ***A47B 3/00*** | (2006.01) |
| ***A47B 3/10*** | (2006.01) |
| ***A47B 27/02*** | (2006.01) |
| ***A47B 27/14*** | (2006.01) |
| ***A47B 27/18*** | (2006.01) |
| ***A47B 3/08*** | (2006.01) |
| ***A47B 13/16*** | (2006.01) |
| ***A47B 3/083*** | (2006.01) |
| *A47B 31/00* | (2006.01) |

(52) U.S. Cl.

CPC ..... *A47B 3/10* (2013.01); *A47B 3/083* (2013.01); *A47B 3/0818* (2013.01); *A47B 13/16* (2013.01); *A47B 27/02* (2013.01); *A47B 27/14* (2013.01); *A47B 27/18* (2013.01); *A47B 31/00* (2013.01); *A47B 2003/0824* (2013.01)

(58) Field of Classification Search

CPC ..... A47B 19/08; A47B 23/04; A47B 23/044; A47B 2023/048; A47B 2023/049; A47B 3/087; A47B 27/00; A47B 27/02; A47B 27/18; A47B 3/0818; A47B 2200/0042; A47B 2200/0043; A47B 2200/0044; A47B 3/0815

USPC ..... 108/132

See application file for complete search history.

(56) References Cited

U.S. PATENT DOCUMENTS

| | | | | |
|---|---|---|---|---|
| 1,770,955 A | | 7/1930 | Storm | |
| 2,567,593 A | * | 9/1951 | Bemis | A47B 3/0818 108/148 |
| 2,683,639 A | | 7/1954 | Brenny | |
| 2,783,109 A | | 2/1957 | Frey | |
| 3,641,946 A | | 2/1972 | Charnay | |
| 4,312,086 A | * | 1/1982 | Bianco | A47B 83/00 108/108 |
| 4,943,040 A | | 7/1990 | Finstad | |
| 6,289,824 B1 | | 9/2001 | Parker et al. | |
| 6,513,443 B2 | | 2/2003 | Todd | |

(Continued)

*Primary Examiner* — Matthew W Ing

(74) *Attorney, Agent, or Firm* — Intellectual Property Law Group LLP

(57) ABSTRACT

A portable plans table configured to be used with a utility cart. The table top can be a non-fold table top, a mono-fold table top, or bi-fold table top that is large enough to support building plans, blueprints and the like. Each table top comprises leg members. The leg members can be panel leg members, a rotatable leg assembly, separate legs, or tubular folding legs. The embodiments of the plans table comprise various combinations of the different table tops and leg members. Each plans table embodiment can easily fold and be carried from one site to another.

15 Claims, 13 Drawing Sheets

(56) References Cited

U.S. PATENT DOCUMENTS

| | | | | |
|---|---|---|---|---|
| 6,701,851 | B2 | 3/2004 | Ibrahim | |
| 7,055,422 | B1 | 6/2006 | Podd | |
| 7,096,797 | B2 | 8/2006 | Sharpe | |
| 7,525,040 | B2 | 4/2009 | Schoffner | |
| 8,424,464 | B2 | 4/2013 | Korpi | |
| 9,125,485 | B2 | 9/2015 | Nafziger | |
| 2001/0027736 | A1* | 10/2001 | Gosselin | A47B 3/0815 108/131 |
| 2003/0213414 | A1* | 11/2003 | Strong | A47B 3/087 108/27 |
| 2005/0241550 | A1* | 11/2005 | Neunzert | A47B 3/00 108/129 |
| 2005/0284790 | A1 | 12/2005 | Gordils | |
| 2007/0260348 | A1 | 11/2007 | Gorils | |
| 2010/0187041 | A1 | 7/2010 | Crouch | |
| 2010/0300334 | A1 | 12/2010 | Tcholakov | |
| 2015/0173505 | A1* | 6/2015 | Mirth | A47B 13/16 211/186 |

* cited by examiner

UTILITY CART PORTABLE PLANS TABLE

CROSS-REFERENCE TO RELATED APPLICATION

This application is a continuation of U.S. patent application Ser. No. 15/829,825, filed on Dec. 1, 2017, and entitled "Utility Cart Portable Plans Table", which is hereby incorporated by reference in its entirety.

BACKGROUND OF THE INVENTION

1. Field of the Invention

The exemplary embodiment(s) of the present invention generally relates to construction. More specifically, the exemplary embodiment(s) of the present invention relates to a lightweight, portable, foldable plans table configured to be used with a utility cart comprising adjustable legs and an adjustable pitch.

2. Background

A principal problem for users such as construction workers, architects, and the like who use a plans table in their daily operation is that it is very difficult to transport the plans table to different sites or to different locations within the same site. Typically, the user needs to build a plans table at each construction site. This creates an inconvenience for the user by having to build multiple plans table for various projects. Another dilemma is the difficulty of having to move the bulky, heavy plans table from one area of the site to another.

There exist plans tables that are static blocks made of wood or metal and are very bulky and difficult to transport. These plans tables cannot be folded and stored behind the seat of a vehicle. Instead, they must be transported in the bed of a truck which takes up space for needed tools. Existing plans tables do not have an adjustable pitch or adjustable legs making it difficult for construction workers of varying height to use. The width of the legs of existing plans table is also not adjustable. Moreover, the tops to existing plans tables are not adjustable making it challenging to read plans when they are larger in size.

For these foregoing reasons, there is a need for a foldable, portable, adjustable plans table that is configured to be used with a utility cart.

SUMMARY

According to an embodiment of the present invention, there is a portable plans table configured to be used on top of a utility cart comprising a table top having a front border, a rear border, a left side border and a right side border with the front border and the rear border extending a depth beneath an under surface of the table top, creating a storable area for foldable support structures attached to the under surface of the table top, the depth equal to at least a maximum thickness of the foldable support structures in a stowed state. In the embodiment, a distance between the left side border and right side border measures a width of the table top and a distance between the front border and rear border measures a length of the table top; and the table top having a nonadjustable pitch created by a height difference along a length of each foldable support structure, wherein the front border is pitched lower than the rear border such that the front border is closer to a top of the utility cart and the rear border is further away from the top of the utility cart.

According to another embodiment of the present invention there is a portable plans table configured to be used on top of a utility cart comprising a table top having a front border, a rear border, a left side border and a right side border, with the front border and the rear border extending a depth beyond an under surface of the table top, creating a storable area for rotatable support structures attached to the under surface of the table top, the depth equal to at least a maximum thickness of the rotatable support structures in a stowed state. In the embodiment, a distance between the left side border and right side border measures a width of the table top and a distance between the front border and rear border measures a length of the table top; and the table top having an adjustable pitch created by the rotatable support structures, wherein each rotatable support structure is adjustable, having a height telescoping range of approximately 2 to 6 inches.

These features, advantages and other embodiments of the present invention are further made apparent, in the remainder of the present document, to those of ordinary skill in the art.

BRIEF DESCRIPTION OF THE DRAWINGS

In order to more fully describe embodiments of the present invention, reference is made to the accompanying drawings. These drawings are not to be considered limitations in the scope of the invention, but are merely illustrative.

DETAILED DESCRIPTION OF SPECIFIC EMBODIMENTS

Figure 1:
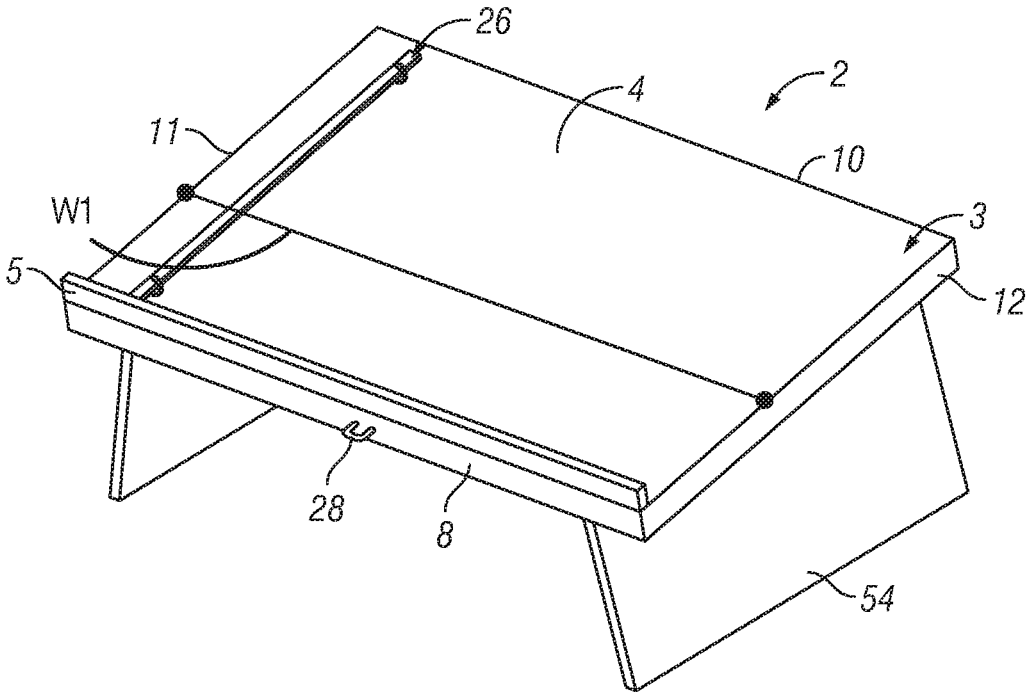
FIG. 1 illustrates a perspective view of a plans table with panel leg members in open position, according to an embodiment of the present invention.

The description above and below and the drawings of the present document focus on one or more currently preferred embodiments and also describe some exemplary optional features and/or alternative embodiments. The description and drawings are for the purpose of illustration and not limitation. Those of ordinary skill in the art would recognize variations, modifications, and alternatives. Such variations, modifications, and alternatives are also within the scope of the present invention. Section titles are terse and are for convenience only.

Throughout the description and drawings, example embodiments are given with reference to specific configurations. It will be appreciated by those of ordinary skill in the art that the present invention can be embodied in other specific forms. Those of ordinary skill in the art would be able to practice such other embodiments without undue experimentation. The scope of the present invention, for the purpose of the present patent document, is not limited merely to the specific example embodiments or alternatives of the foregoing description.

Various embodiments of the present invention illustrated in the drawings may not be drawn to scale. Rather, the dimensions of the various features may be expanded or reduced for clarity. In addition, some of the drawings may be simplified for clarity. Thus, the drawings may not depict all of the components of a given apparatus (e.g., device) or method.

The disclosure relates to a portable, foldable plans table 2 configured to operate with a utility cart. Typical utility cart widths are about 16 inches to 24 inches. There are multiple embodiments of the plans table 2 and the embodiments comprise a structural ribbing on the under surface 6 to provide structural integrity. In one embodiment, the plans table 2 does not have a foldable table top. In another embodiment, the plans table 2 has a mono-fold table top. In yet another embodiment, the plans table 2 has a bi-fold table top. The table top 3 has a front border 8, a rear border 10, a left side border 11 and a right side border 12, with the front border 8 and the rear border 10 extending a depth beneath an under surface 6 of the table top 3, creating a storable area for foldable support structures attached to the under surface 6 of the table top 3 The depth of the front and rear border that extends past the under surface is equal to at least a maximum thickness of the foldable support structures in a stowed state. Alternatively, or in addition, the left side border 11 and the right side border 12 extends a depth beneath an under surface 6 of the table top 3, creating a storable area for foldable support structures attached to the under surface 6 of the table top 3. The depth of the left side border and the right side border would be equal to at least a maximum thickness of the foldable support structures in a stowed state.

Figure 13:
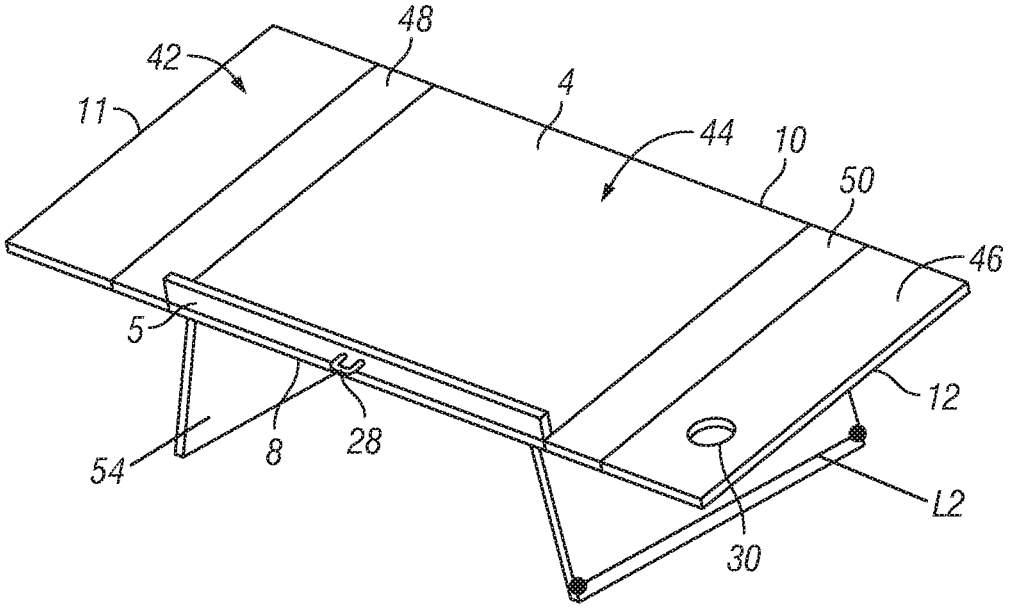
FIG. 13 illustrates a perspective view of a yet another embodiment of a plans table with panel leg members in open position, according to an embodiment of the present invention.

The direction of the width is referred to as W1 for all the table top embodiments as labeled in FIG. 1. The direction of the length is referred to as L1 for all the table top embodiments as labeled in FIG. 2 and L2 for all the panel leg members as illustrated in FIG. 13. The length L2 of the panel leg members 54 is bound by the front edge and the back edge. These various table tops can be mixed and matched with various support structures. The embodiments of the support structure can be panel leg members 54, a rotatable leg assembly 56 (which can also be called rotatable support structures), multiple separate legs 58, and tubular folding legs 62. The rotatable leg assembly 56, which can also be called rotatable support structures, have with the ability to adjust to two cart sizes and abut the cart lip 65. Separate legs 58 can also be called separate adjustable legs. The disclosure separately discusses the variations in table tops and variations in leg members. Any of the table tops can have a coffee cup holder attached or built into the table top. Likewise, a container 68 for writing or measuring tools can be attached or built anywhere into the table top.

FIGS. 1-18 illustrate plans table 2 with panel leg members 54, according to an embodiment of the present invention. In an embodiment of the foldable plans table 2, the foldable plans table 2 is large enough to support full size plans for construction and the like. In the non-foldable table top embodiment illustrated in FIG. 1, the table top 3 can be 40-48 inches in width W1 and 26-38 inches in length L1. The height of the plans table 2 ranges depending on the height of the panel leg members 54. For example, the front edge of the panel leg members 54 can be around 6 inches to 10 inches and increase in height until it reaches the rear (back edge) at a height of around 10 inches to 16 inches. The incline of the panel leg members 54 creates the pitch for the plans table 2. The plans table 2 has an upper surface 4 and an under surface 6 (not shown, see FIG. 3), a front border 8 that faces the user, a rear border 10 that faces away from the user, a left side border 11, and a right side border 12. The under surface 6 is a storable area where the support structures are stowed. There is a lip 5 attached to the front border 8 extending up from the upper surface to prevent the plans from sliding down. A handle 28 is attached to the front border 8 for easy handling. A spring clip bar 26 is attached on the upper surface 4 substantially close to the left side border 11 or rear border 10, however, the spring clip bar 26 can be attached anywhere on the upper surface 4 and is used to support the plans.

Figure 2:
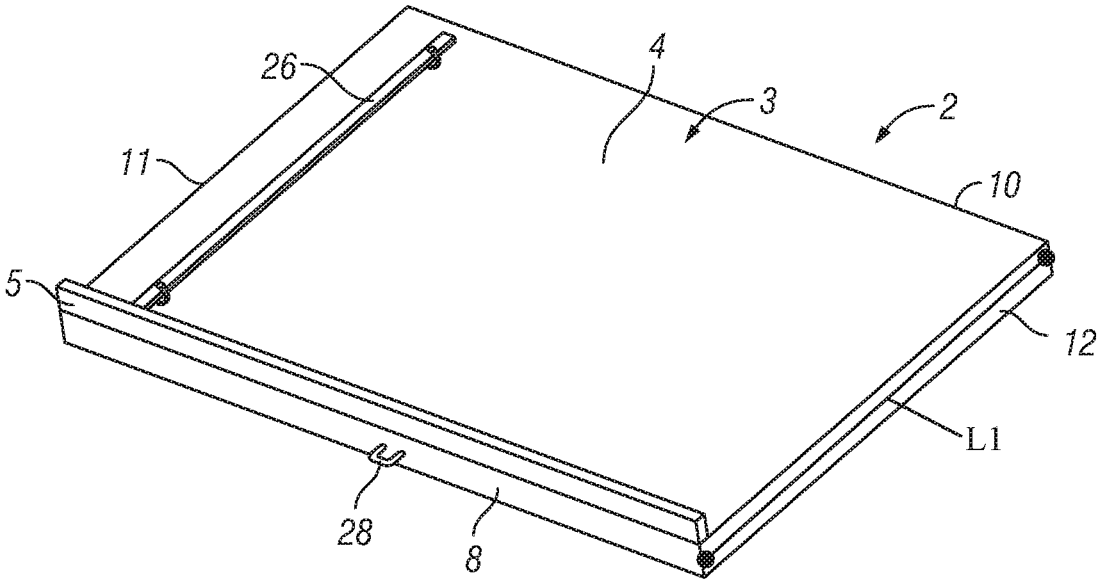
FIG. 2 illustrates a perspective view of a plans table with panel leg members in folded position, according to an embodiment of the present invention.
Figure 3:
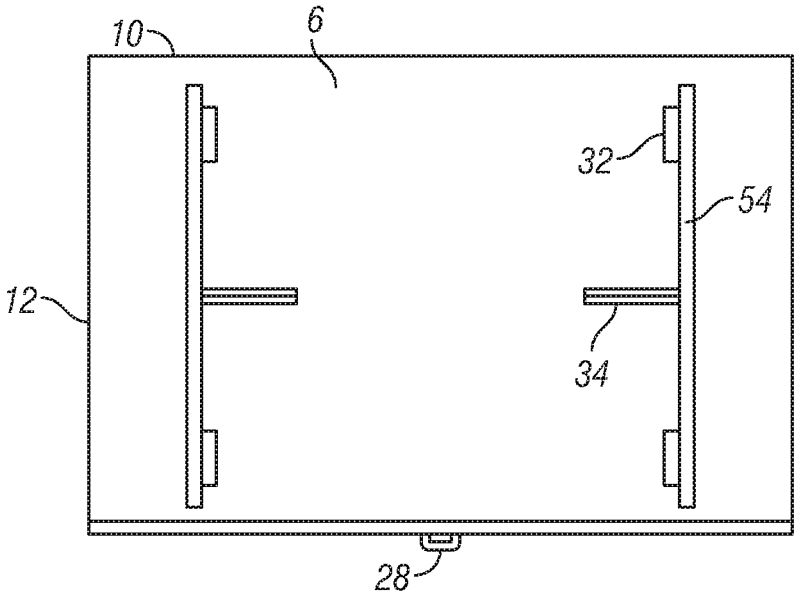
FIG. 3 illustrates a bottom view of a plans table with panel leg members in open position, according to an embodiment of the present invention.
Figure 4:
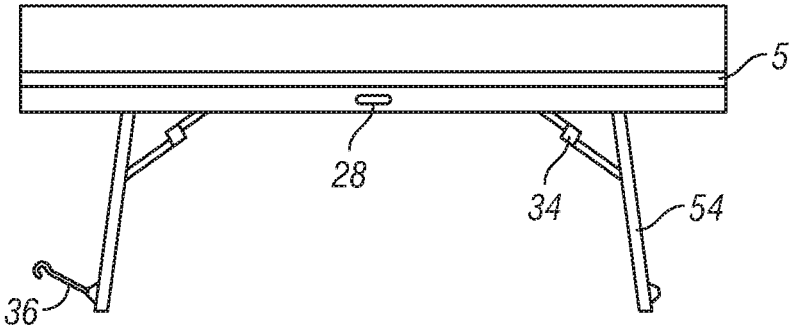
FIG. 4 illustrates a front elevation view of a plans table with panel leg members in open position, according to an embodiment of the present invention.
Figure 5:
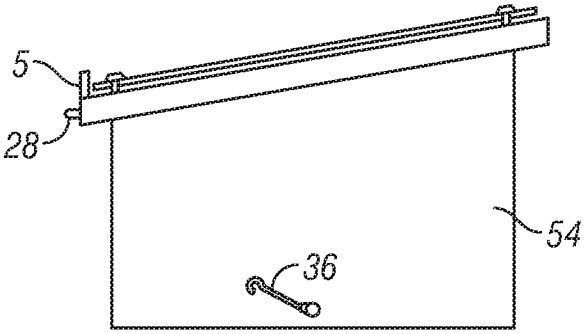
FIG. 5 illustrates a right elevation view of a plans table with panel leg members in open position, according to an embodiment of the present invention.
Figure 6:
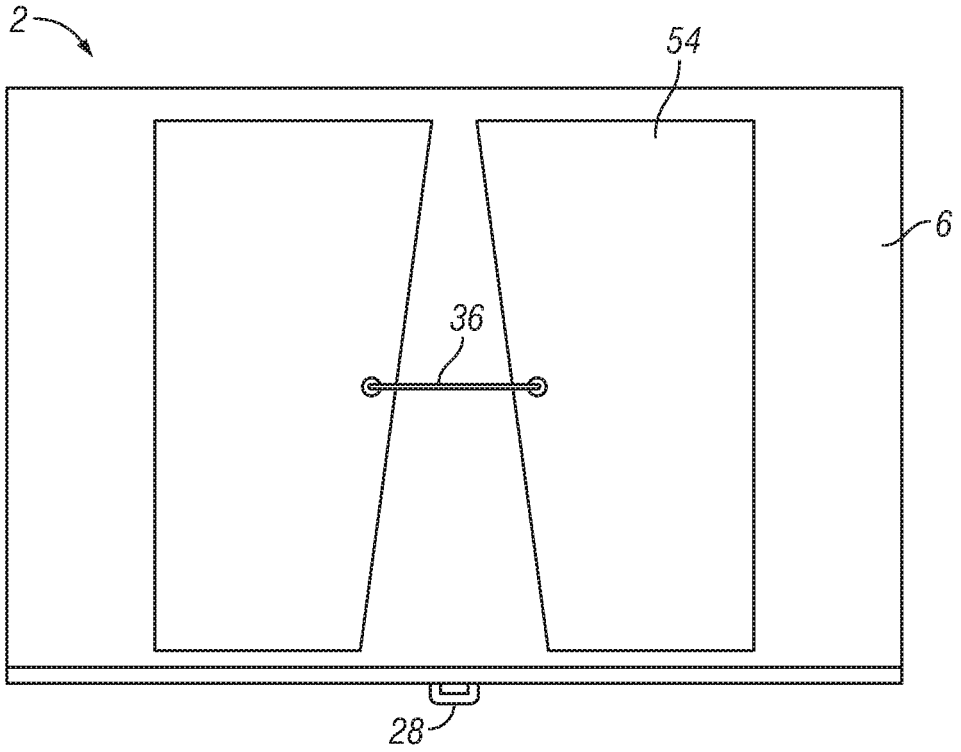
FIG. 6 illustrates a bottom view of a plans table with panel leg members in closed position, according to an embodiment of the present invention.

The material of the plans table 2 can be made of wood, metal such as: stainless steel, carbon steel, aluminum. It can also be plastic such as: polyoxmethylene (POM), polycarbonate (PC), polyethylene terephthalate (PET or PETE), high-density polyethylene (HDPE), polyvinyl chloride (PVC), low-density polyethylene (LDPE), polypropylene (PP), polystyrene (PS), acrylonitrile butadiene styrene (ABS). The plans table 2 can be a custom solid piece of plastic or can be produced by a structural foam mold injection process. For both process types, the plastic materials listed above can be utilized. The panel leg members 54 connect to the undersurface 6 of the table top 3. FIG. 2 illustrates a perspective view of a plans table with panel leg members in folded position, according to an embodiment of the present invention. FIG. 3 illustrates a bottom view of a plans table with panel leg members 54 in open position, according to an embodiment of the present invention. The hinge 32 has a locking brace 34 that locks the panel leg members 54 in place when the plans table 2 is in open position. FIG. 4 illustrates a front elevation view of a plans table 2 with panel leg members 54 in open position, according to an embodiment of the present invention. There is a locking latch 36 that holds the panel leg members 54 in closed position so the user can easily carry the plans table 2. The locking brace 34 locks the panel leg members 54 in place. FIG. 5 illustrates a right elevation view of a plans table 2 with panel leg members 54 in open position, according to an embodiment of the present invention. FIG. 6 illustrates a bottom view of a plans table 2 with panel leg members 54 in closed position, according to an embodiment of the present invention. The locking latch 36 is shown to lock the two panels 54 in place.

Figure 7:
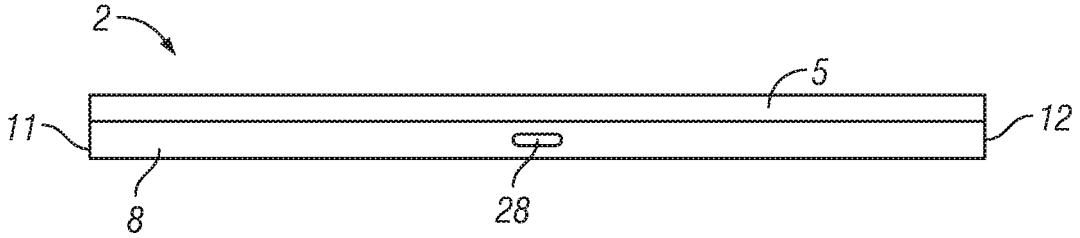
FIG. 7 illustrates a front elevation view of a plans table with panel leg members in closed position, according to an embodiment of the present invention.
Figure 8:
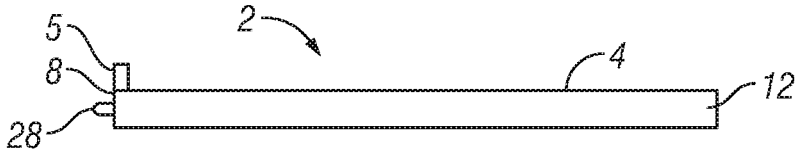
FIG. 8 illustrates a side elevation view of a plans table with panel leg members in closed position, according to an embodiment of the present invention.

FIG. 7 illustrates a front elevation view of a plans table 2 with panel leg members 54 in closed position, according to an embodiment of the present invention. When in closed position, the plans table 2 is portable and slim. FIG. 8 illustrates a side elevation view of a plans table 2 with panel leg members 54 in closed position, according to an embodiment of the present invention. A shown in this embodiment, the right side border 12 extends a depth beneath the under surface 6 such that a storable space is formed in which the folded panel leg members 54 are in a closed or stowed position, such that the panel leg members 54 do not protrude past the depth of the side border when in a stowed position. In other embodiments of the present invention, at least two opposing borders (11, 12 or 8, 10) extend a depth beneath the under surface 6, the depth being equal to at least a thickness of the folded panel leg members in the stowed position.

Figure 9:
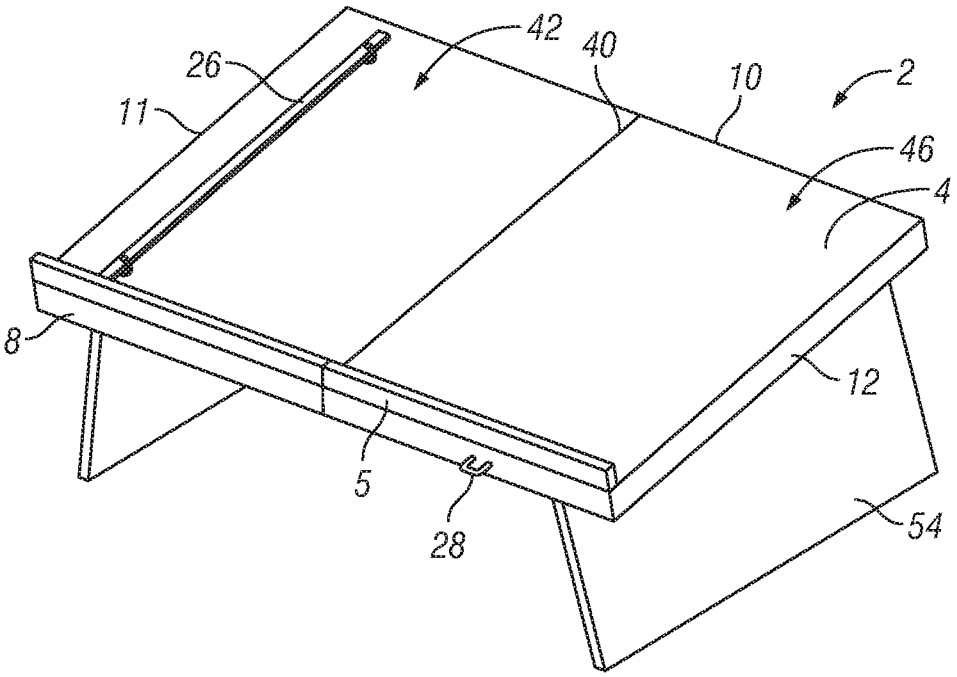
FIG. 9 illustrates a perspective view of another embodiment of a plans table with panel leg members in open position, according to an embodiment of the present invention.

FIG. 9 illustrates a perspective view of a plans table 2 with panel leg members 54 in open position that is mono-fold, according to an embodiment of the present invention. In another embodiment of the foldable plans table 2, the foldable plans table 2 is large enough to support full size plans for construction and the like. In this embodiment, the table top can be about 48-74 inches in width W1 and 26-38 inches in length L1. The height of the plans table 2 depends on the support structure connected to the table top. The height at the front of the plans table 2 can be approximately 6 inches and increase to about 16 inches in the rear. For example, the front of the panel leg members 54 can be around 6 inches to 10 inches and increase in height until it reaches the rear at a height of around 10 inches to 16 inches. The table top has an upper surface 4, under surface 6 (not shown, see FIG. 10), front border 8, rear border 10, left side border 11 and right side border 12. The table top has a left panel 42 and a right panel 46. The left panel 42 and right panel 46 can each be about 24-37 inches wide and about 26-38 inches in length. The height of the plans table 2 ranges depending on the height of the panel leg members 54. The incline of the panel leg members 54 creates the pitch for the plans table 2.

The plans table 2 is constructed by attaching the right panel 46 and the left panel 42 together preferably by a hinge 32, such as a piano hinge (not shown), locking hinge or traditional hinge. The hinge 32 allows the table top 3 to fold in half, preferably along the width midline 40. A spring clip bar 26 is attached to the upper surface 4 of the table top, preferably on the left panel 42 edge. A lip 5 is connected to the front border of the table top 3 to prevent plans from sliding down. A handle 28 is attached to the front border 8 for carrying and folding the plans table 2. The plans table 2 can be made of wood, metal such as: stainless steel, carbon steel, aluminum. It can also be plastic such as: polyoxmethylene (POM), polycarbonate (PC), polyethylene terephthalate (PET or PETE), high-density polyethylene (HDPE), polyvinyl chloride (PVC), low-density polyethylene (LDPE), polypropylene (PP), polystyrene (PS), acrylonitrile butadiene styrene (ABS).

Figure 10:
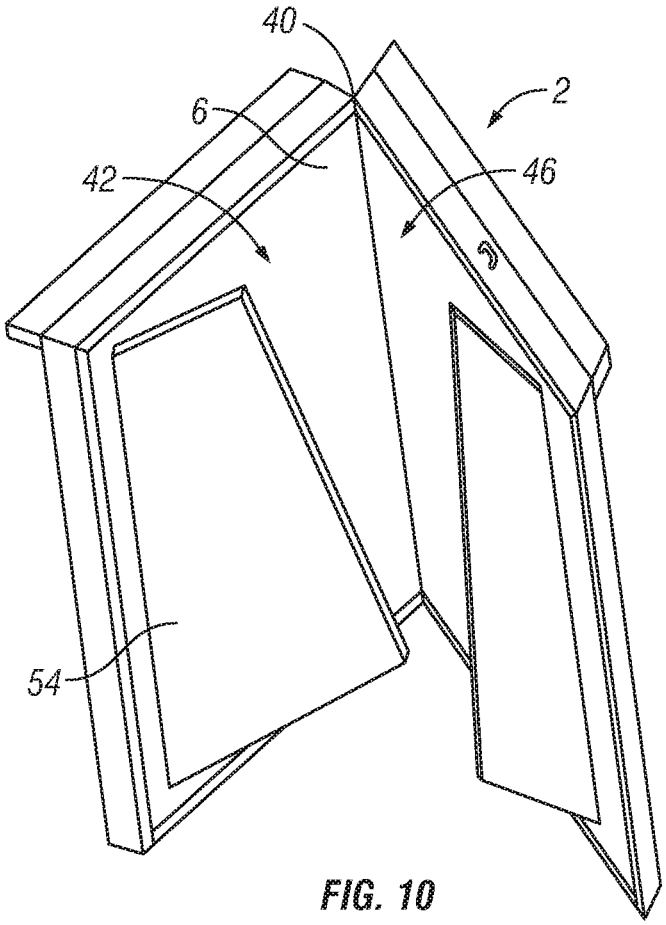
FIG. 10 illustrates a bottom view of another embodiment of a plans table partially folded and the panel leg members in a partially closed position, according to an embodiment of the present invention.
Figure 11:
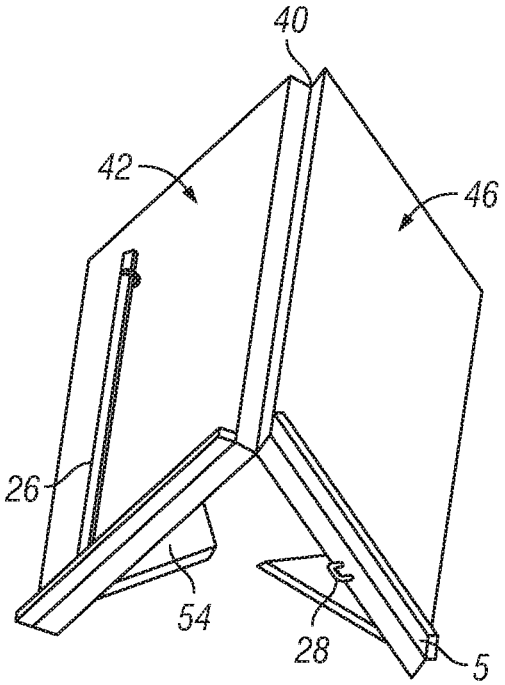
FIG. 11 illustrates a top view of a plans table partially folded and the panel leg members in a partially closed position, according to an embodiment of the present invention.
Figure 12:
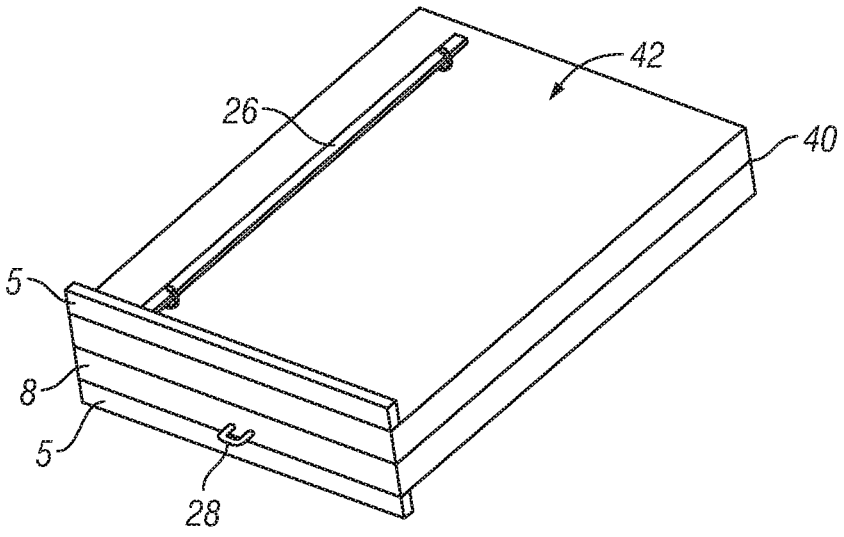
FIG. 12 illustrates a perspective view of a plans table completely folded and the panel leg members in a closed position, according to an embodiment of the present invention.

As illustrated in FIGS. 10 and 11, the two halves of the table top fold towards each other along the midline 40 along a lengthwise direction so that the under surfaces 6 of the left panel 42 and right panel 46 are facing each other when the plans table 2 is in closed position. The panel leg members 54 collapse against the under surface 6 and are stowed when the plans table 2 is in closed position to make it compact and portable. FIG. 11 illustrates a top view of a plans table 2 partially folded and the panel leg members in a partially closed position, according to an embodiment of the present invention. FIG. 12 illustrates a perspective view of a plans table 2 completely folded and the panel leg members 54 (not shown, see FIG. 11) in a closed position, according to an embodiment of the present invention. By making the plans table 2 compact, it is easily stored and carried to different sites.

In another embodiment of the plans table 2, the plans table 2 has a bi-fold table top large enough to support full size plans for construction and the like as illustrated in FIG. 13-17. The table top has an upper surface 4, under surface 6 (not shown, see FIG. 15), front border 8, rear border 10, left side border 11 and right side border 12. The table top has a left panel 42, a middle panel 44, and a right panel 46. In between the left panel 42 and middle panel 44, there is a left panel insert 48. Likewise, in between the right panel 46 and middle panel 44, there is a right panel insert 50. The left panel insert 48 and right panel insert 50 allow the table top 3 to fold and stay in the closed position. The left panel 42 can be about 16 inches-23 inches in width W1 to about 26-38 inches in length L1. The middle panel 44 can be about 32 inches-46 inches in width W1 to about 26-38 inches in length L1. The right panel 46 can be about 16 inches-23 inches in width W1 to about 26-38 inches in length L1. The left panel insert 48 and the right panel insert 50 can be about 2 inches-3 inches in width W1 to about 26-38 inches in length L1. A coffee cup holder 30 can be made on the table top. There is also a handle 28. For example, the panel leg members 54 can be about 16 to 24 inches in length L2.

Figure 14:
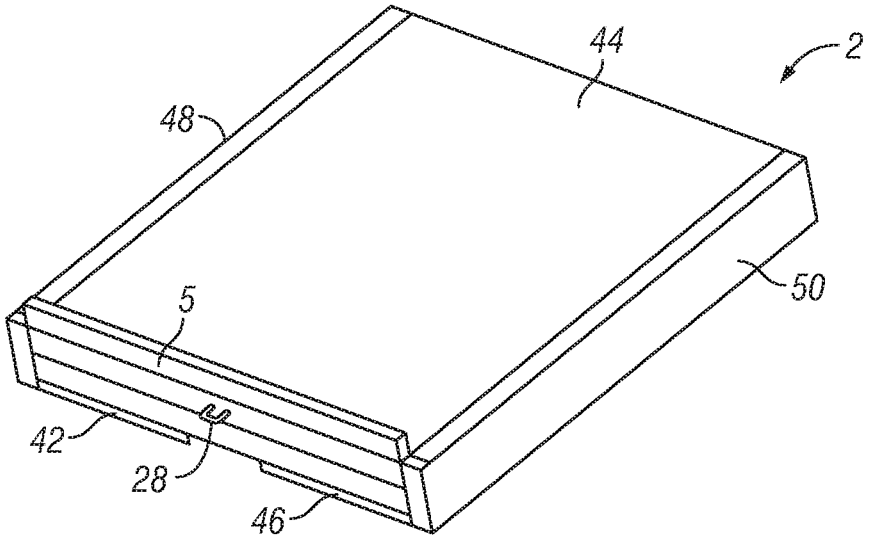
FIG. 14 illustrates a perspective view of a plans table folded and the panel leg members in closed position, according to an embodiment of the present invention.
Figure 15:
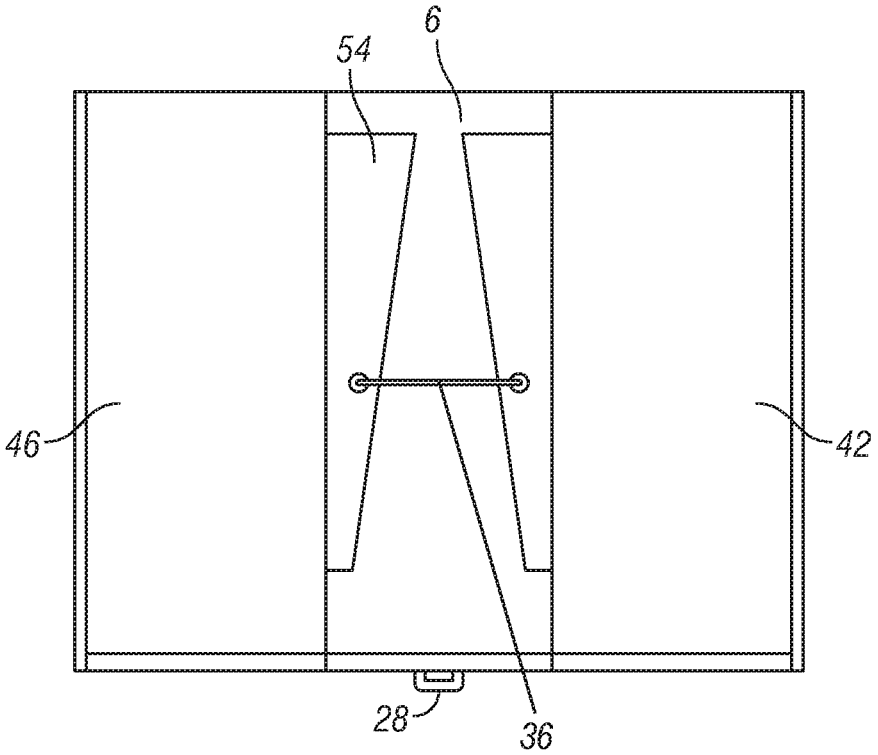
FIG. 15 illustrates a bottom view of a plans table substantially folded and the panel leg members in closed position, according to an embodiment of the present invention.
Figure 16:
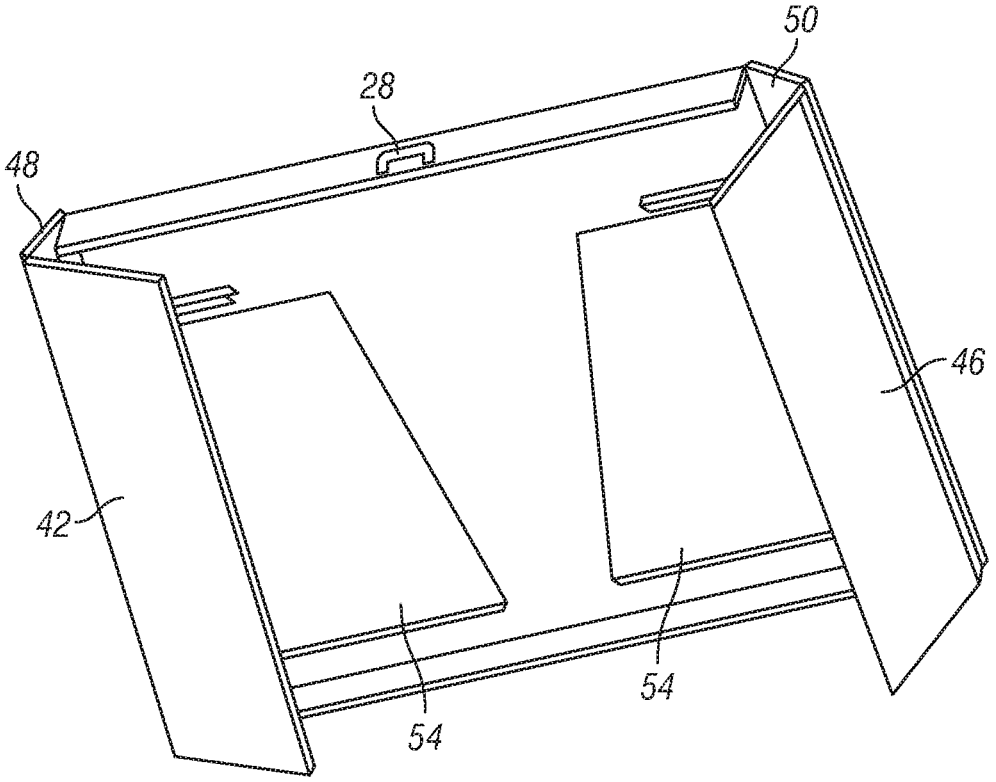
FIG. 16 illustrates a bottom view of a plans table partially folded and the panel leg members in closed position, according to an embodiment of the present invention.

FIGS. 14 and 15 illustrate a perspective view of a plans table 2 folded and the panel leg members 54 (not shown, see FIG. 15) in closed position, according to an embodiment of the present invention. FIG. 15-16 illustrates a bottom view of a plans table 2 substantially folded and the panel leg members 54 in closed position, according to an embodiment of the present invention. There is a locking latch 36 used to secure the panels 54. The right panel 46 and the left panel 42 are folded against the under surface 6. The under surface 6 is a storable area for the panel leg members 54. FIG. 16 illustrates a bottom view of a plans table partially folded and the panel leg members in closed position, according to an embodiment of the present invention. The table top folds substantially flat in the closed position. A closed position is maintained using a locking mechanism such as a loop with a locking latch or a sliding mechanism that locks into a slot. As illustrated in FIG. 16, there is an embodiment of the foldable plans table 2 wherein the front border 8 and the rear border 10 extend a depth beneath an under surface 6 of the table top 3, creating a storable area for foldable support structures attached to the under surface 6 of the table top 3, the depth equal to at least a maximum thickness of the foldable support structures in a stowed state.

Figure 17:
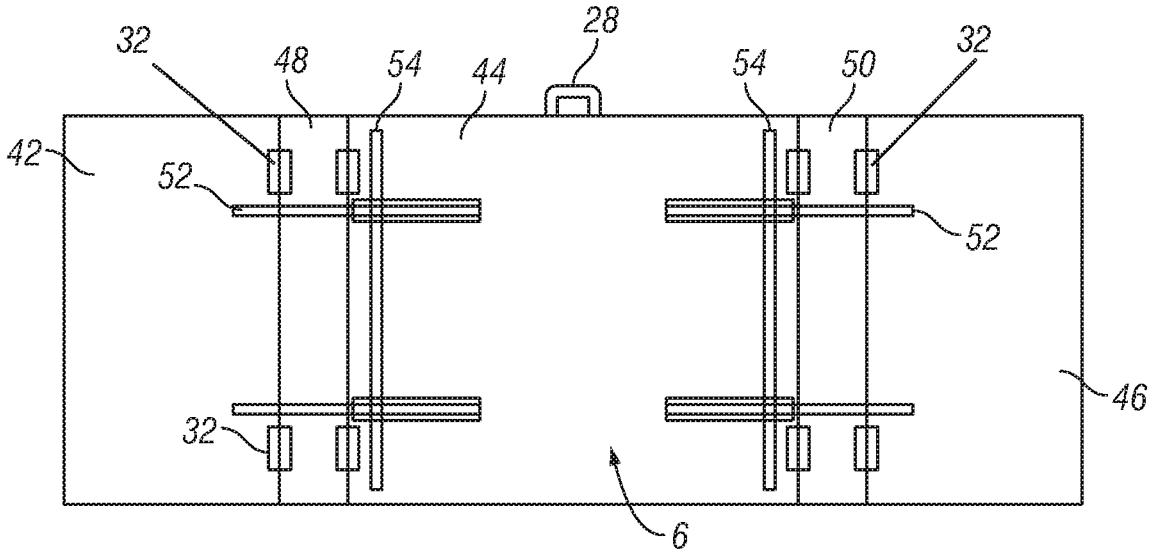
FIG. 17 illustrates a bottom view of a plans table in open position, according to an embodiment of the present invention.

As illustrated in FIG. 17 the table top is constructed by aligning and connecting the left panel 42 to the left panel insert 48 with a connecting mechanism such as a hinge 32, preferably a piano hinge. Similarly, the right panel 46 is connected to the right panel insert 50 with a connecting mechanism such as a hinge 32, preferably a piano hinge. The left panel insert 48 is connected to the middle panel 44 and the right panel insert 50 is connected to the opposing side of the middle panel 44 with a connecting mechanism such as a hinge 32, preferably a piano hinge. Panel supports 52 are connected to the under surface 6 of the table top and are used to support the left panel 42 and right panel 46 so they are even with the middle panel 44.

As illustrated in FIG. 17, to extend the left panel 42 and right panel 46 to the same level as the middle panel 44, the user pulls the left panel 42 and right panel 46 up to the same level as the middle panel 44 and pulls the panel support 52 to extend it past the left panel 42 and right panel 46. When the user closes the table top 3, the user pushes each of the panel support 52 back into the casing and folds down the left panel 42 and right panel 46. The panel leg members 54 are connected to substantially the left and right side of the middle panel 44.

The material of the plans table 2 can be made of wood, metal such as: stainless steel, carbon steel, aluminum. It can also be plastic such as: polyoxmethylene (POM), polycarbonate (PC), polyethylene terephthalate (PET or PETE), high-density polyethylene (HDPE), polyvinyl chloride (PVC), low-density polyethylene (LDPE), polypropylene (PP), polystyrene (PS), acrylonitrile butadiene styrene (ABS). The panel leg members 54 connect to the undersurface 6 of the table top 3. The panel leg members 54 collapse against the under surface 6 and are stowed when the plans table 2 is in closed position to make it compact and portable.

There are various embodiments of support structures that can be attached to the under surface 6 of a table top 3. Below, embodiments of support structures are disclosed, then a combination of various table tops 3 with variation of support structures will be disclosed thereafter.

Figure 18:
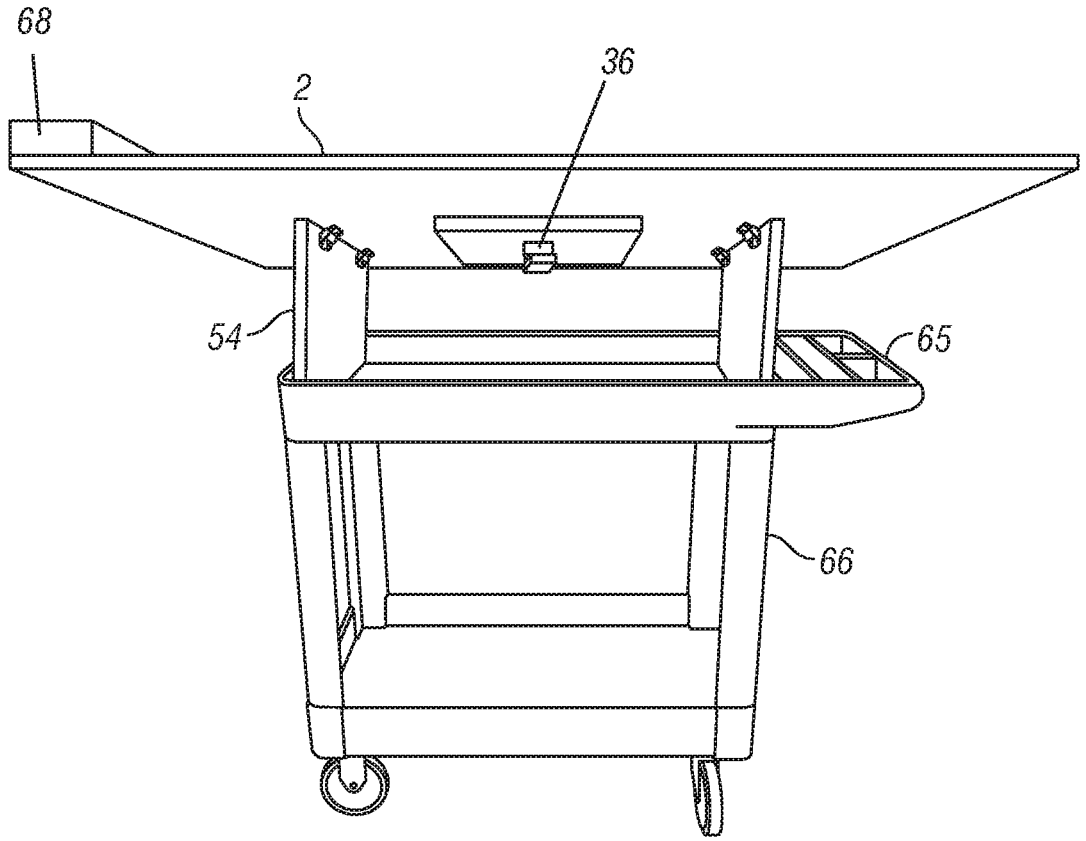
FIG. 18 illustrates a plans table with panel leg members being used on top of a utility cart, according to an embodiment of the present invention.
Figure 19:
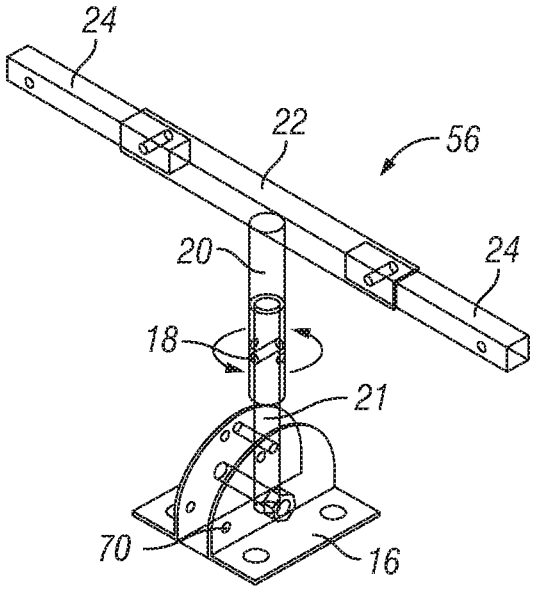
FIG. 19 illustrates a perspective view of a rotatable leg assembly, according to an embodiment of the present invention.
Figure 20:
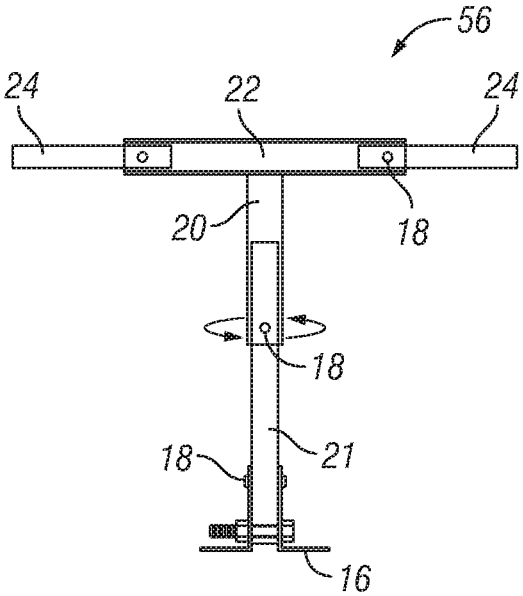
FIG. 20 illustrates a front view of a rotatable leg assembly, according to an embodiment of the present invention.
Figure 21:
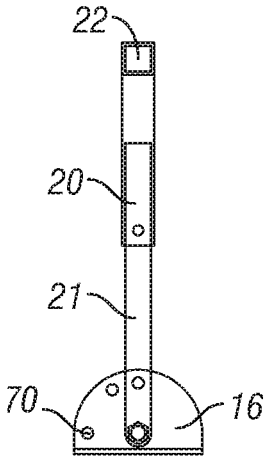
FIG. 21 illustrates a right elevation view of a rotatable leg assembly, according to an embodiment of the present invention.
Figure 22:
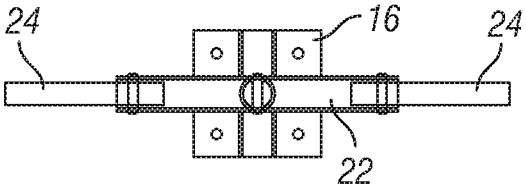
FIG. 22 illustrates a top view of a rotatable leg assembly, according to an embodiment of the present invention.

The support structure can be two panels 54 connected to the under surface 6 of each embodiment of the table top 3 via a connecting mechanism such as a hinge 32. The panel leg members 54 are solid and can be made of wood, metal such as: stainless steel, carbon steel, aluminum. It can also be plastic such as: polyoxmethylene (POM), polycarbonate (PC), polyethylene terephthalate (PET or PETE), high-density polyethylene (HDPE), polyvinyl chloride (PVC), low-density polyethylene (LDPE), polypropylene (PP), polystyrene (PS), acrylonitrile butadiene styrene (ABS). The panel leg members 54 can be a custom solid piece of plastic or can be produced by a structural foam mold injection process. For both process types, the plastic materials listed above can be utilized. The panel leg members 54 are cut to a certain pitch so the table top can be set at a range of about 10-25 degrees angle. For example, the front of the panel leg members 54 can be around 6 inches to 10 inches and increase in height until it reaches the rear at a height of around 10 inches to 16 inches. Each panel leg member 54 are connected to the under surface 6 substantially close to the left side border 11 and right side border 12. The panel leg members 54 are connected by hinges 32 which allow the panel leg members 54 to fold against the under surface 6 when in closed position. There is a locking latch 36 that holds the panel leg members 54 in closed position so the user can easily carry the plans table 2. The hinge 32 has a locking brace 34 that locks the panel leg members 54 in place when the plans table 2 is in open position. The measurements of the panel leg members 54 allow the plans table 2 to position securely on top of a utility cart. For example, the ends of the base of each panel leg member 54 abut the inside surface of the lip 65 at the top of the utility cart 66. As illustrated in FIG. 18, the lip 65 of the top surface of the utility cart 66 prevents the plans table 2 from moving. There is also an optional container 68 for pencils, pens, tools and the like.

FIGS. 19-22 illustrate another embodiment of support structure that can be a rotatable leg assembly 56 or be called rotatable support structures. The rotatable leg assembly 56 comprises a plate 16, an outer vertical segment 20, an inner vertical segment 21 and a horizontal segment 22, also referred to as an adjustable base. The outer vertical segment 20 and inner vertical segment 21 can move in a telescoping manner so as to adjust the height of the rotatable leg assembly 56. The plate 16 connects the rotatable leg assembly 56 to the under surface 6 of the table top. The plate 16 is located substantially to the left side border 11 and right side border 12 of the table top. For the bi-fold table top 3, the plate 16 is located substantially to the left side border 11 and right side border 12 of the middle panel 44. The horizontal segment 22 is about 16 inches long and has extensions 24 on both sides that can extend out to fit different size utility carts. Each extension 24 extends about six inches from the horizontal segment 22. The total length of the extensions 24 and horizontal segment 22 can adjust from about 16 inches to 24 inches. The total length of the inner vertical segment 21 and outer vertical segment 20 can adjust from about 12 inches to 16 inches. The extensions 24 are locked into place by a mechanism such as a snap button 18. The outer vertical segment 20 rotates 90 degrees from closed to open position and is locked into place with a mechanism such as a snap button 18. The rotatable leg assembly 56 can be made out of metal but other materials can be contemplated.

Figure 23:
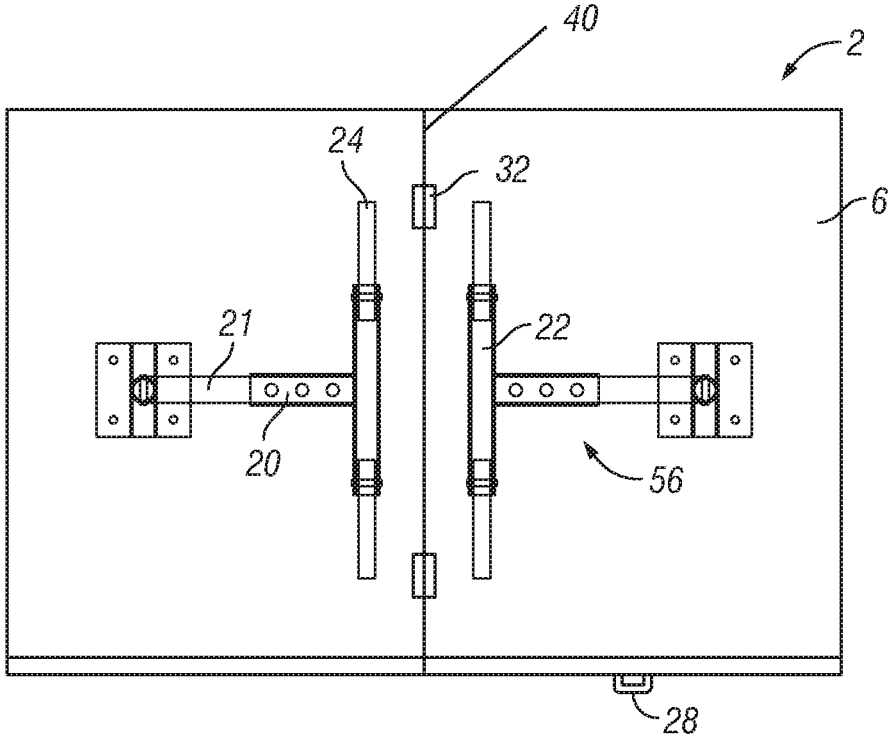
FIG. 23 illustrates a bottom view of a rotatable leg assembly folded against the under surface, according to an embodiment of the present invention.
Figure 24:
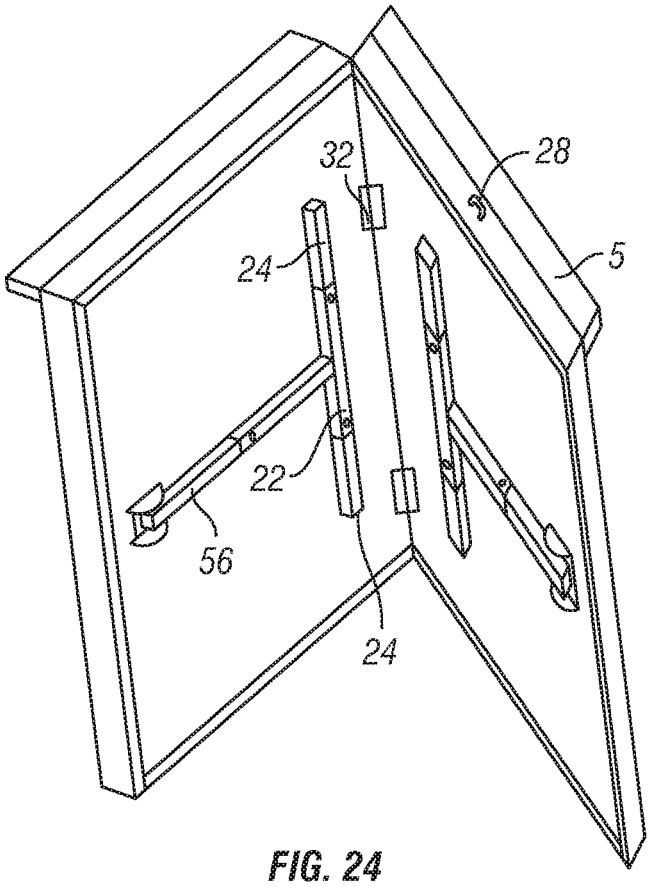
FIG. 24 illustrates a bottom perspective view of a rotatable leg assembly folded against the under surface of a plans table partially in closed position, according to an embodiment of the present invention.
Figure 25:
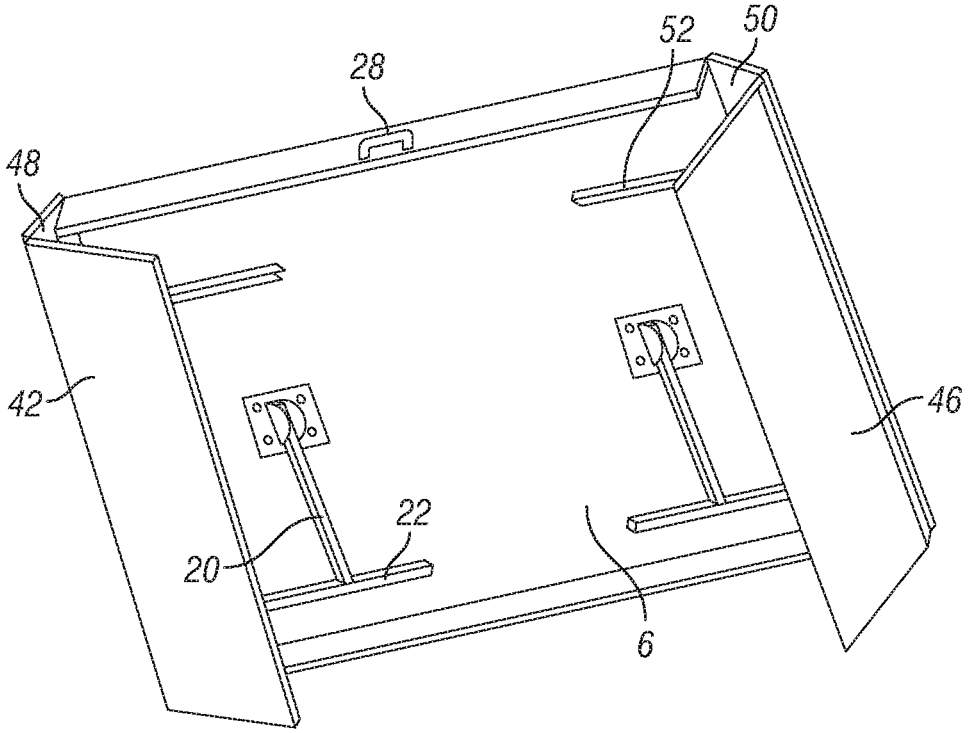
FIG. 25 illustrates yet another bottom perspective view of a leg assembly folded against the under surface of a plans table partially in closed position, according to an embodiment of the present invention.
Figure 26:
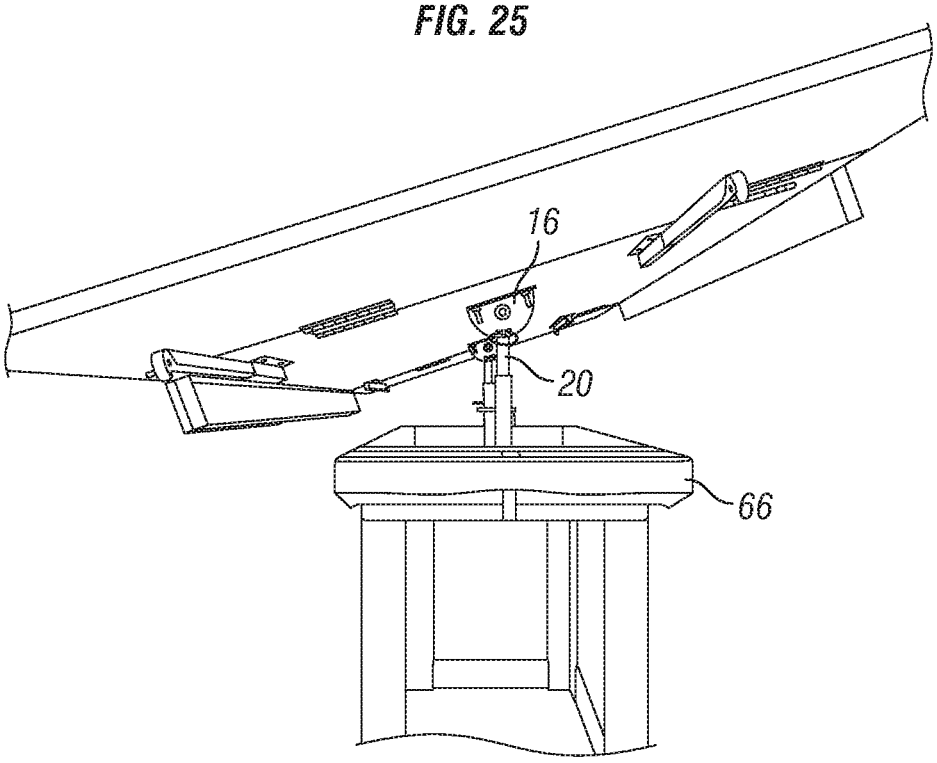
FIG. 26 illustrates a right elevation view of a plans table with the rotatable leg assembly on top of a utility cart, according to an embodiment of the present invention.
Figure 27:
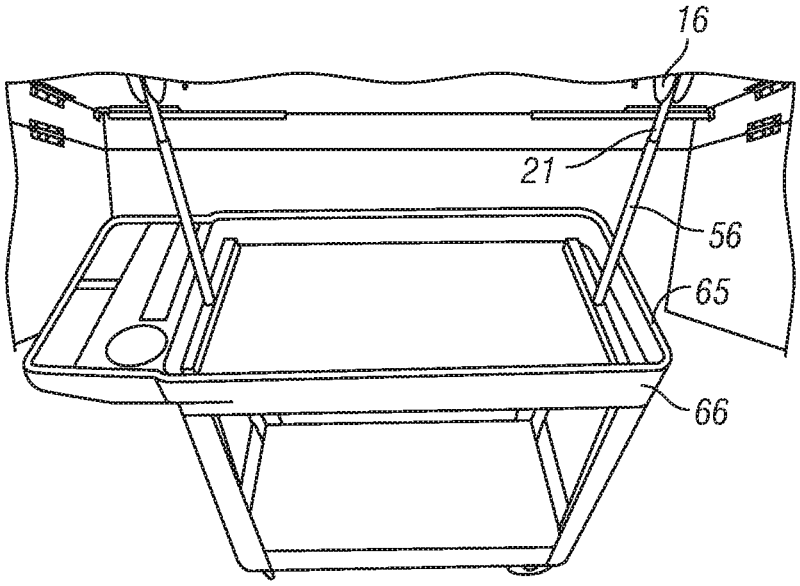
FIG. 27 illustrates the lip of the utility cart abutting the support structures, according to an embodiment of the present invention.

FIG. 23 illustrates a bottom view of a rotatable leg assembly folded against the under surface, according to an embodiment of the present invention. There are hinges 32 such as piano hinges at the midline 40, which allows the mono-fold plans table to fold in half. There can be separate hinges as illustrated in FIG. 23 or one continuous hinge. The rotatable leg assembly 56 can be stowed along the width or the length of the plans table. FIG. 24 illustrates a bottom perspective view of a rotatable leg assembly folded against the under surface of a plans table partially in closed position, according to an embodiment of the present invention. The rotatable leg assembly 56 can be positioned as shown in FIG. 25. FIG. 25 illustrates yet another bottom perspective view of a leg assembly folded against the under surface of a plans table partially in closed position, according to an embodiment of the present invention. FIG. 26 illustrates a right elevation view of a plans table with the rotatable leg assembly on top of a utility cart, according to an embodiment of the present invention. FIG. 27 illustrates the lip 65 of the utility cart 66 abutting the rotatable leg assembly 56, according to an embodiment of the present invention.

To move the rotatable leg assembly 56 from closed position to open position, one option is the user lifts up the rotatable leg assembly 56 from against the under surface 6, releases the locking mechanism, such as a snap button 18 and extends the extensions 24 so that the rotatable leg assembly 56 abut the lip 65 of the utility cart 66. Another option to move the rotatable leg assembly 56 from closed position to open position, the user lifts up the rotatable leg assembly 56 from against the under surface 6, releases the locking mechanism, such as a snap button 18 and rotates the outer vertical segment 20 about 90 degrees and locks it in place with the inner vertical segment 21 using a locking mechanism such as a snap button. If the top surface of the utility cart is wider, the length of the horizontal segment 22 can be adjusted by extending the extensions 24. The plate 16 has three holes 70 which allow the rotatable leg assembly 56 to be positioned in preferably three different configurations. The first configuration is when the rotatable leg assembly 56 lays substantially flat against the under surface 6 in closed position. The second configuration is when the table top is at a range from 10 to 30 degrees pitch relative to the rotatable leg assembly 56. The third configuration is when the table top is substantially at 90 degrees to the rotatable leg assembly 56. The height of the rotatable leg assembly 56 is telescopically adjustable ranging from about 2 inches to 6 inches in height adjustment.

The rotatable leg assembly 56 can be made of metal such as: stainless steel, carbon steel, aluminum. It can also be plastic such as: polyoxmethylene (POM), polycarbonate (PC), polyethylene terephthalate (PET or PETE), high-density polyethylene (HDPE), polyvinyl chloride (PVC), low-density polyethylene (LDPE), polypropylene (PP), polystyrene (PS), or acrylonitrile butadiene styrene (ABS).

Figure 28:
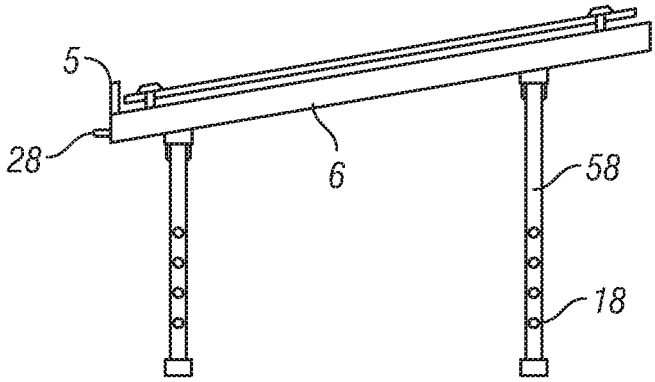
FIG. 28 illustrates a right elevation view of a plans table with separate legs, according to an embodiment of the present invention.
Figure 29:
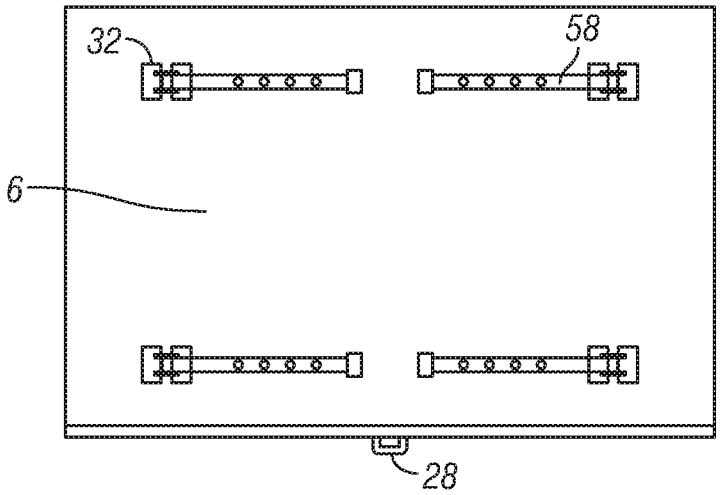
FIG. 29 illustrates a bottom view of a plans table with separate legs folded down, according to an embodiment of the present invention.
Figure 30:
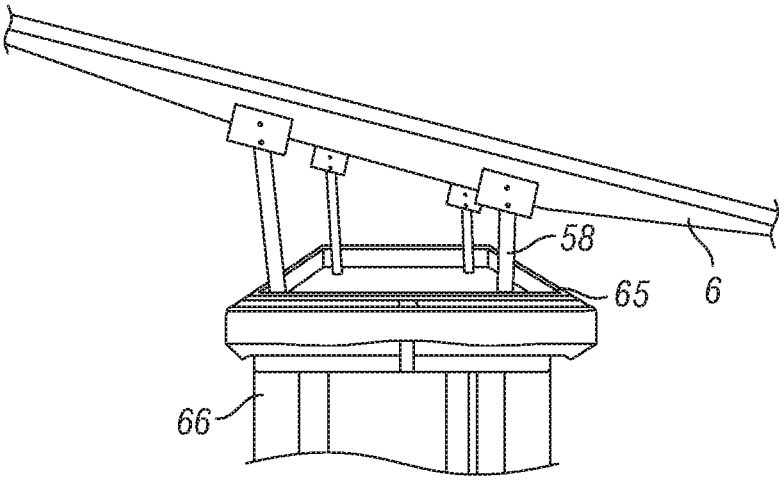
FIG. 30 illustrates a left elevation view of a plans table with separate legs on top of a utility cart, according to an embodiment of the present invention.

Another embodiment of a support structure comprises four separate legs 58 as illustrated in FIGS. 28-30, each connected to the under surface 6 of the table top by a connecting mechanism, such as a hinge 32. Each leg 58 can adjust to different heights as each leg comprises holes that can be secured at different heights using a locking mechanism, such as a snap button 18. When the user needs the plans table 2 to be set at a pitch, the user can adjust the back two legs 58 at a higher height than the front two legs 58.

As illustrated in FIG. 29, the legs 58 can be folded down in a compartment along the width of the under surface 6 or along the length of the under surface 6 making the plans table 2 compact and portable. As illustrated in FIG. 30, the legs 58 can be about 6 inches to 12 inches in height in the front and about 12 inches to 16 inches in height in the back. The legs 58 can each be secured to the under surface 6 at about 9.5 inches in from the left side border 11 and right side border 12 and about 8.5 inches in from the front border 8 and rear border 10; substantially close to the edge of the various table tops so that the legs 58 can provide sufficient support and balance to the plans table 2. The legs 58 can be secured to the under surface 6 with folding table leg brackets that mount to the under surface 6 of the table top 3 in which the plans table 2 will have a pitched wedge where the bracket mounts. Once the legs 58 are in closed position, the legs 58 will be secured by a leg holder/clip which will allow the leg to be locked in a closed position. When the plans table 2 sits in the utility cart 66, each leg separately abuts the lip 65 of the utility cart 66 to provide stability and prevent movement of the plans table 2.

The leg 58 can be made of metal such as: stainless steel, carbon steel, aluminum. It can also be plastic such as: polyoxmethylene (POM), polycarbonate (PC), polyethylene terephthalate (PET or PETE), high-density polyethylene (HDPE), polyvinyl chloride (PVC), low-density polyethylene (LDPE), polypropylene (PP), polystyrene (PS), or acrylonitrile butadiene styrene (ABS).

Figure 31:
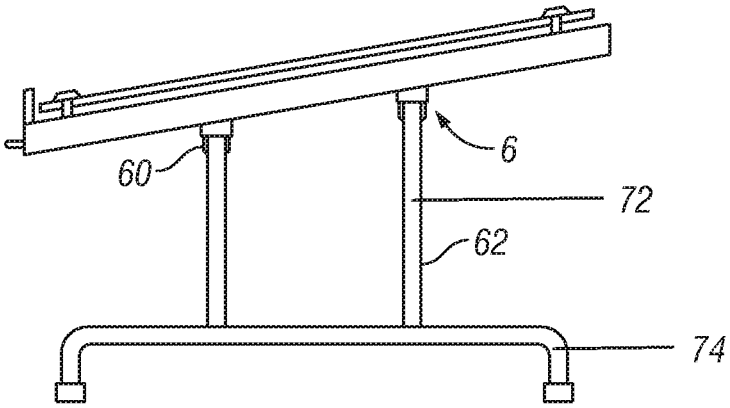
FIG. 31 illustrates a right elevation view of a plans table with tubular folding legs, according to an embodiment of the present invention.
Figure 32:
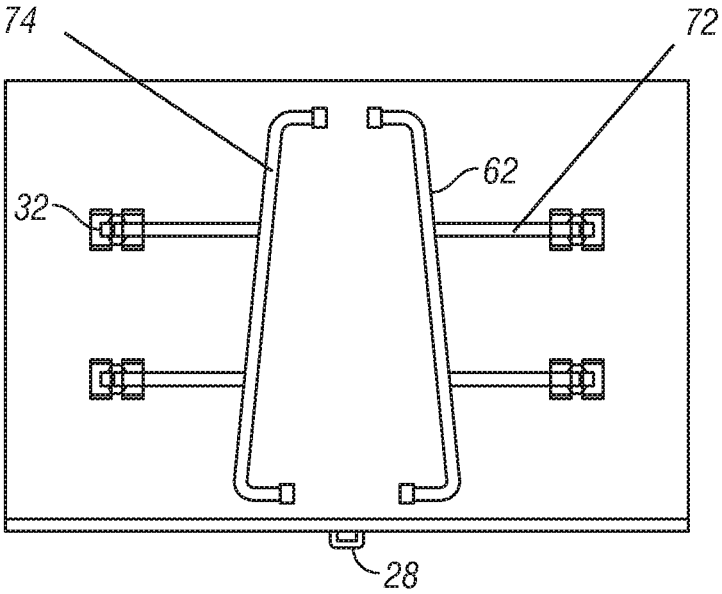
FIG. 32 illustrates a bottom view of a plans table with tubular folding legs folded against the under surface, according to an embodiment of the present invention.

Another embodiment of a support structure comprises tubular folding legs 62 as illustrated in FIGS. 31 and 32, each connected to the under surface 6 of the table top by a connecting mechanism such as a hinge 32 or bracket 60. The tubular folding legs 62 comprise two vertical structures 72 and a base 74. The first end of each vertical structure 72 attach to the under surface 6 of the plans table 2 and the second end attach to the base 74. The tubular folding legs 62 are located substantially towards the left side border 11 and right side border 12 of the table top. For the bi-fold table top, the tubular folding legs 62 are located substantially to the left side border 11 and right side border 12 of the middle panel 44. The pitch of the table top can be adjustable or nonadjustable. The pitch can be adjusted by moving the bracket 60. The pitch can be nonadjustable as the tubular folding legs 62 are manufactured at a specific pitch. There is a locking mechanism such as a snap button 18 or bracket 60 to keep the tubular folding legs 62 from collapsing in the open position. The locking brace 32 can be released and each tubular folding legs 62 can fold towards the middle of the non-fold table top 3, the mono-fold table top or bi-fold table top when in closed position. Once the folding legs 62 is in its closed position, the folding legs 62 will be secured by a leg holder/clip which will allow the leg to be locked in a closed position. The height of the tubular folding legs 62 can be about 6-8 inches in the front and about 12-16 inches in height at the back. The length of the tubular folding legs can be about 14 inches to about 30 inches in order to fit on the top of a utility cart. The tubular folding legs 62 can be made of metal such as: stainless steel, carbon steel, aluminum. It can also be made of plastic such as: polyoxmethylene (POM), polycarbonate (PC), polyethylene terephthalate (PET or PETE), high-density polyethylene (HDPE), polyvinyl chloride (PVC), low-density polyethylene (LDPE), polypropylene (PP), polystyrene (PS), acrylonitrile butadiene styrene (ABS).

While particular embodiments of the present invention have been shown and described, it will be obvious to those of skills in the art that based upon the teachings herein, changes and modifications may be made without departing from this exemplary embodiment(s) of the present invention and its broader aspects. Therefore, the appended claims are intended to encompass within their scope all such changes and modifications as are within the true spirit and scope of this exemplary embodiment(s) of the present invention.

What is claimed is:

1. A portable plans table configured to be used on top of a utility cart comprising:

a table top having a front border, a rear border, a left side border and a right side border, with the front border and the rear border extending a depth beyond an under surface of the table top, creating a storable area for rotatable support structures attached to the under surface of the table top, the depth equal to at least a maximum thickness of the rotatable support structures in a stowed state;

a distance between the left side border and right side border measures a width of the table top and a distance between the front border and rear border measures a length of the table top;

wherein each rotatable support structure comprises an inner vertical segment coaxial with an outer vertical segment, the outer vertical segment being rotatable to about 90 degrees relative to the inner vertical segment, and a bottom of the outer vertical segment is connected to an extendable horizontal segment to abut an inside dimension of a top of a utility cart such that the portable plans table is affixed to the utility cart, to provide mobility to the portable plans table and to prevent the portable plans table from sliding.

2. The portable plans table according to claim 1, wherein the inner vertical segment and the outer vertical segment has a height telescoping range of approximately 2 to 6 inches.

3. The portable plans table of claim 2, wherein the inner vertical segment and the outer vertical segment lock into a position by a snap button.

4. The portable plans table according to claim 1, wherein the table top has an adjustable pitch.

5. The portable plans table according to claim 4, wherein the pitch of the table top is adjustable at a range from about 10 to 30 degrees relative to the rotatable support structure.

6. The portable plans table according to claim 4, wherein the pitch of the table top is adjustable to about 90 degrees relative to the rotatable support structure.

7. The portable plans table according to claim 1, wherein the table top is a mono-fold.

8. The portable plans table according to claim 1, wherein the table top is a bi-fold.

9. The portable plans table according to claim 1, wherein the table top is approximately 40 to 96 inches in width and approximately 26 to 38 inches in length.

10. The portable plans table of claim 1, wherein the table top is foldable along a lengthwise direction.

11. The portable plans table of claim 1, wherein the extendable horizontal segment is about 16 inches long.

12. The portable plans table of claim 11, wherein the extendable horizontal segment extends from about 16 inches to 24 inches.

13. The portable plans table of claim 1, wherein the rotatable support structures are storable along a lengthwise direction in the storable area.

14. The portable plans table of claim 1, wherein the rotatable support structures are storable along a widthwise direction in the storable area.

15. The portable plans table of claim 1, wherein the rotatable support structures are made from a material selected from the group consisting of polyoxmethylene (POM), polycarbonate (PC), polyethylene terephthalate (PET or PETE), high-density polyethylene (HDPE), polyvinyl chloride (PVC), low-density polyethylene (LDPE), polypropylene (PP), polystyrene (PS), or acrylonitrile butadiene styrene (ABS).

* * * * *